US006725885B2

(12) United States Patent
Mahr

(10) Patent No.: US 6,725,885 B2
(45) Date of Patent: Apr. 27, 2004

(54) SAILCLOTH

(75) Inventor: Peter Frank Mahr, Weston, CT (US)

(73) Assignee: North Sails Group, LLC, Milford, CT (US)

( * ) Notice: Subject to any disclaimer, the term of this patent is extended or adjusted under 35 U.S.C. 154(b) by 251 days.

(21) Appl. No.: 09/862,366

(22) Filed: May 22, 2001

(65) Prior Publication Data

US 2002/0177377 A1 Nov. 28, 2002

(51) Int. Cl.[7] ..... D03D 35/00
(52) U.S. Cl. ..... 139/383 R; 139/420 A; 139/426 R; 442/203
(58) Field of Search ..... 139/383 R, 420 A, 139/426 R; 442/203

(56) References Cited

U.S. PATENT DOCUMENTS

| | | | | | |
|---|---|---|---|---|---|
| 3,473,576 | A | * | 10/1969 | Amneus | 139/420 R |
| 5,323,725 | A | * | 6/1994 | Conrad et al. | 114/102.3 |
| 5,333,568 | A | * | 8/1994 | Meldner et al. | 114/102.31 |
| 6,257,160 | B1 | * | 7/2001 | Keire | 114/102.29 |
| 6,260,497 | B1 | * | 7/2001 | Keire | 114/102.29 |
| 6,302,044 | B1 | * | 10/2001 | Baudet | 114/102.33 |
| 6,311,633 | B1 | * | 11/2001 | Keire | 114/102.33 |

* cited by examiner

*Primary Examiner*—John J. Calvert
*Assistant Examiner*—Robert H. Muromoto, Jr.
(74) *Attorney, Agent, or Firm*—Pyle & Piontek

(57) ABSTRACT

A warp oriented woven sailcloth is provided in warp yarns are relatively uncrimped relative to the fill yarns. The yarn weight ratios (fill vs. warp) are 1.0 to 1 and 0.22 to 1.

4 Claims, No Drawings

SAILCLOTH

BACKGROUND OF THE INVENTION

Present day sailcloth is made from a variety of materials, with one of the most common being a tightly woven cloth of polyester yarns. Sailcloth is the most tightly woven textile in the world and requires extensively modified heavy looms to generate the necessary forces to attain such a dense construction. Normally, polyester sailcloth is only woven in what is known as a plain weave, in which every warp yarn passes over and under each fill yarn, with the yarns being crimped over each other. After weaving, the cloth is impregnated with a resin and is heated, causing the resin to cure and also causing the polyester fabric to shrink.

The above described weaving method tends to impart certain characteristics to the cloth due to the nature of the operation itself. The warp yarns, which run in the machine on long direction tend to crimp more than the weft or fill yarns, which run in the cross machine direction. Sails of this nature are made up of a number of joined panels, and it is desirable to align the yarns with less crimp along directions of maximum stress or load in the sail. This, in turn, reduces stretch, which would otherwise cause the sail to lose its ideal or designed shape when subjected to increasing wind forces.

Fill oriented cloth imposes limitations on how panels can be cut and arranged in a sail while still making efficient use of the cloth. A common design using fill oriented cloth is a so-called cross cut design, in which the seams are substantially horizontal, and the fill yarns run from the top to the bottom of the sail.

Studies of the properties of sails have demonstrated that in triangular sails, especially genoas or jibs, the main forces radiate out of the corners of the sail. It becomes desirable to have sail panels which radiate out of the corners of the sail, and the most efficient way to accomplish this is with warp oriented cloth, e.g., cloth in which the warp yarns are relatively uncrimped.

One proposed solution to manufacture warp oriented polyester sailcloth is simply lower or reduce the fill yarn density by reducing or decreasing the fill yarn count per inch, thus increasing the spacing between the fill yarns. This approach is technically inferior for at least two reasons. The lower fill count significantly reduces the diagonal stability of the cloth, causing undesirable increased stretch along the bias. Also, lowering the fill count only partially reduces crimp in the warp yarns and also reduces the density of the weave. Thus, the cloth can still stretch in the warp direction and has a low service life.

In current fill oriented woven polyester fabrics, the natural tendency of the warp to crimp more than the fill is accentuated by using larger (heavier) fill yarns than warp yarns. The ratio of fill yarn weight to warp yarn weight is typically between 1.67 to 1 and 4.5 to 1. The density of these fabrics (as later defined herein) are in the order of 1,500 to 2,050 in the warp and from 1,000 to 1,330 in the fill.

SUMMARY OF THE INVENTION

In accordance with the present invention a novel woven fabric of polyester or other heat shrinkable yarn is provided with yarn orientation in the warp direction, that is, crimp is imparted to the fill yarns while leaving the warp yarns relatively uncrimped, and also while producing the desired high fiber density fabric. This is accomplished by increasing the spacing between warp yarns to levels higher than current conventional fabrics and reversing the yarn weight ratios (fill vs. warp) to values between 1.0 to 1 and 0.22 to 1. This provides densities (as defined herein) in the warp of 970 to 1,500 and in the fill of greater than 1,400. The resulting cloth is then finished in a conventional fashion and is ready to be cut into panels.

DETAILED DESCRIPTION

In the present invention, the sailcloth is a plain weave and comprises 100% polyester or other heat shrinkable yarns, with a minimal value of shrinkage in the order of 10%, and with most polyester yarns shrinking greater than 15% when heated to temperatures in the order of 300 to 400° F. As envisioned, the fabrics of the present invention contemplate the use of warp yarns weighing from 100 to 2,000 denier and fill yarns having a denier of 30 to 1,000. In the alternative, the warp yarns may comprise monofilaments.

In addition to the above, the ratio of fill yarn weight to warp yarn weight is from 1.0 to 1 and 0.22 to 1. Surprisingly, this results in a woven cloth in which the warp yarns are relatively uncrimped.

As used herein, the term "density" of a fabric is determined by multiplying the square root of the yarn in denier which is a number proportional to the effective diameter of the yarn, by the yarns count per inch. Acceptable fabrics of the present invention are envisioned to have warp densities between 970 and 1,300 and concurrent fill densities greater than 1,400, or more generally, the warp density will be less than the fill density.

As an example of a specific fabric, the fabric would comprise 55 yarns per inch of 500 denier polyester in the warp and 135 yarns per inch of 200 denier in the fill. Using the above density calculation, this would result in a cloth having a warp density of 1,230 and a fill density of 2,002. When viewed at high magnification, the warp yarns are relatively uncrimped, and the densities are sufficient to provide a fabric having good stretch resistance along the bias.

Subsequent to weaving, the fabric is subjected to additional finishing operations. For example, the fabric is first cleaned to remove any sizings. Then the fabric is dipped into an aqueous bath of heat curable resin, such as melamine, which serves to lock the woven geometry and decrease stretch. The fabric is then dried and then heat-set by passing through an oven, causing the yarns to shrink, thereby increasing density. The fabric is then calendared by passing the fabric between a pair of rolls under high pressure, with one of the rolls being heated.

After the finishing operation, the cloth may be used as such to construct a sail made from panels. The panels are arranged such that the uncrimped warp yarns follow the major lines of stress in the sail when the sail is used. For example, the panels may radiate from the corners of a triangular sail.

What is claimed is:

1. A sailcloth comprising a woven cloth of heat shrinkable fill and warp yarns, the weight ration of the fill yarns to the warp yarns being between 1.0 to 1 and 0.22 to 1, said cloth having a density in the warp of 970 to 1,500 and a density in the fill being greater than 1,400.

2. The sailcloth of claim 1 wherein the warp yarns have a denier of from 100 to 2,000 and the fill yarns have a denier of 30 to 1,000.

3. The sailcloth of claim 1, wherein the warp yarns comprise monofilaments.

4. The sailcloth of claim 1 wherein the heat shrinkable yarns comprise polyester yarns.

* * * * *